US009861168B2

(12) United States Patent
Ma

(10) Patent No.: US 9,861,168 B2
(45) Date of Patent: Jan. 9, 2018

(54) FREE ARM UMBRELLA

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 15/005,374

(22) Filed: Jan. 25, 2016

(65) Prior Publication Data

US 2016/0206059 A1 Jul. 21, 2016

Related U.S. Application Data

(63) Continuation of application No. 13/793,100, filed on Mar. 11, 2013, now Pat. No. 9,241,549, which is a (Continued)

(30) Foreign Application Priority Data

Dec. 21, 2010 (CN) ..... 2010 2 0674383 U

(51) Int. Cl.
*A45B 11/00* (2006.01)
*A45B 23/00* (2006.01)

(52) U.S. Cl.
CPC ..... *A45B 11/00* (2013.01); *A45B 23/00* (2013.01); *A45B 2023/005* (2013.01); (Continued)

(58) Field of Classification Search
CPC ..... A45B 11/00; A45B 2023/0031; A45B 2023/0075; A45B 2023/005; A45B 2023/0025
(Continued)

(56) References Cited

U.S. PATENT DOCUMENTS 1,475,025 A 11/1923 Newman et al.
1,740,653 A 12/1929 Hunneman, Jr.
(Continued)

FOREIGN PATENT DOCUMENTS

CN 2323633 6/1999
CN 2452349 10/2001
(Continued)

OTHER PUBLICATIONS http://www.prostor.be/en/product/Telescopicarmparasol/P3/Video.html.
(Continued)

*Primary Examiner* — David R Dunn
*Assistant Examiner* — Danielle Jackson
(74) *Attorney, Agent, or Firm* — Knobbe Martens Olson & Bear, LLP

(57) ABSTRACT

A free arm umbrella includes a fixing plate (1), an upper nest (2), a lower nest (3), umbrella ribs (5) and support ribs (6). The umbrella ribs (5) are hinged with the upper nest (2) and the two ends of the support rib (6) are hinged with the lower nest (3) and the umbrella rib (5) respectively. The free arm umbrella also includes a control mechanism (7), a support rod (9), a first strut rod (10) and a second strut rod (20). The two ends of the first strut rod (10) are hinged with the lower nest (3) and the upper portion of the fixing plate (1) respectively. One end of the second strut rod (20) is hinged with the upper nest (2) and the other end is provided with a support block (21). The middle part of the first strut rod (10) is hinged with the middle part of the second strut rod (20). The two ends of the support rod (9) are hinged with the second strut rod (20) and the fixing plate (1) respectively. The control mechanism (7) is fixed on the fixing plate (1). The support block (21) is moveably fixed on the control mechanism (7). A rotating lockout mechanism (8) can also (Continued)

be set on the free arm umbrella so that the umbrella cover can be rotated easily. The free arm umbrella has advantages of simple structure, convenience of use, economic practicality, and being applicable to narrow space.

17 Claims, 11 Drawing Sheets

Related U.S. Application Data continuation-in-part of application No. PCT/CN2011/071154, filed on Feb. 22, 2011.

(52) U.S. Cl.
CPC ..... *A45B 2023/0025* (2013.01); *A45B 2023/0075* (2013.01); *A45B 2023/0081* (2013.01)

(58) Field of Classification Search
USPC ..... 135/20.1, 21, 25.2, 27; 248/289.11, 248/288.11, 674
See application file for complete search history.

(56) References Cited

U.S. PATENT DOCUMENTS

| | | | | |
|---|---|---|---|---|
| 2,640,673 | A | 6/1953 | Bureau | |
| 3,603,556 | A | 9/1971 | Frantz | |
| 4,586,525 | A | 5/1986 | Glatz et al. | |
| 4,606,366 | A | 8/1986 | Collet | |
| 4,930,738 | A | 6/1990 | Lombardo | |
| 6,230,727 | B1 | 5/2001 | Chen | |
| 6,401,735 | B1 | 6/2002 | Chou | |
| 6,637,717 | B2 * | 10/2003 | Li | A45B 23/00 135/20.3 |
| 6,694,993 | B2 | 2/2004 | Chou | |
| 7,398,790 | B2 | 7/2008 | Glatz | |
| 8,281,942 | B2 | 10/2012 | Meltzer | |
| 8,807,513 | B2 * | 8/2014 | Volin | A45B 23/00 135/16 |
| 9,241,549 | B2 | 1/2016 | Ma | |
| 2006/0054285 | A1 | 3/2006 | Louis | |
| 2007/0075202 | A1 | 4/2007 | Gordon | |
| 2009/0084744 | A1 | 4/2009 | Meltzer | |
| 2013/0092200 | A1 | 4/2013 | May | |
| 2013/0269738 | A1 | 10/2013 | Ma | |

FOREIGN PATENT DOCUMENTS

| | | |
|---|---|---|
| CN | 2461340 | 11/2001 |
| CN | 2461337 | 11/2007 |
| DE | 10129578 | 9/2002 |
| WO | WO 2007/054043 | 5/2007 |
| WO | WO 2012/083607 | 6/2012 |
| WO | WO 2013/013474 | 1/2013 |

OTHER PUBLICATIONS http://www.youtube.com/watch?v=QMo3prf9mu4 &feature=player_embedded.
International Preliminary Report on Patentability in Application No. PCT/CN2011/071154, dated Jun. 25, 2013 in 10 pages.
Extended European Search Report issued in European Application No. 14158518.2, dated May 16, 2014 in 9 pages.

* cited by examiner

FREE ARM UMBRELLA

CROSS-REFERENCE TO RELATED APPLICATIONS

The entirety of each of International Application No. PCT/CN2011/071154, filed Feb. 22, 2011 and Chinese Patent Application No. 201020674383.8, filed Dec. 21, 2010, are hereby incorporated by reference.

BACKGROUND

Field of the Invention

This application is directed to products for providing shade from the sun or protection from the wind, rain, snow, or other elements, particularly as related to umbrellas. In some embodiments, a free arm umbrella (e.g., cantilever, wall-mounted, etc.) is provided, mainly used for hanging or securing on a wall.

Description of the Related Art

Generally, sun-shading products currently on the market are commonly known for being complicated in structure, high in price, and occupying a relatively large amount of space. With living spaces decreasing in size in buildings, homes and apartments in cities and other environments, there is a demand for products that allow people living in such environments to enjoy outdoor leisure in the shade in small places (e.g., a balcony). This application is directed to improved free arm umbrella structures, featuring favorable price, structure, and compactness at least when stowed.

SUMMARY

Overcoming disadvantages mentioned above, this application is directed to an effort to provide a free arm umbrella for large-scale application, which features simple structure, easy operation, low or affordable price and usability in a narrow, small, or limited space.

To meet the ends or objectives described above, in some embodiments, the following technical solutions are adopted for these free arm umbrellas:

In some embodiments, the free arm umbrella includes a fixing plate, an upper hub (e.g., nest), a lower hub (e.g., nest), umbrella ribs and support ribs. The umbrella ribs are hingedly coupled with the upper nest and the first and second ends of each of the support ribs are hingedly coupled with the lower nest and one of the umbrella ribs respectively. In some embodiments, the free arm umbrella also includes a control mechanism, a support rod, a first strut rod and a second strut rod. The first and second ends of the first strut rod are hingedly coupled with the lower nest and the upper portion of the fixing plate respectively. One end of the second strut rod is hingedly coupled with the upper nest and the other end is provided with a support block. A middle part of the first strut rod or portion positioned between the first and second ends is hingedly coupled with the middle part of the second strut rod or portion positioned between the two ends of the second strut rod. The first and second ends of the control mechanism support rod are hingedly coupled with the second strut rod and the fixing plate respectively. The control mechanism is fixed on the fixing plate. The support block is moveably fixed on the control mechanism.

In some embodiments, the free arm umbrella also includes a rotating lockout mechanism. The fixing plate includes a first fixing plate and a second fixing plate. The rotating lockout mechanism is set or positioned between the first fixing plate and the second fixing plate, and respectively fixed onto the two plates. The support rod, control mechanism and first strut rod are all hingedly coupled with the second fixing plate.

In some embodiments, an upper part of the first fixing plate can be flexibly connected to an upper part of the second fixing plate.

In some embodiments, the rotating lockout mechanism comprises a knob handle, fastening screw, first latch segment and second latch segment. The first latch segment engages with the second latch segment. The fastening screw runs through the first and second latch segments, and engages with the knob handle. The first latch segment is fixed on the second fixing plate, while the second latch segment on the first fixing plate, the support rod hinged with the second fixing plate, and the control mechanism on the second fixing plate.

In some embodiments, the free arm umbrella is also equipped with a first L-shape flat bar and a second L-shape flat bar. The first L-shape flat bar and second L-shape flat bar are fixed respectively with the second fixing plate and the first fixing plate, and at the same time are held, secured and/or supported respectively by the first latch segment and second latch segment.

Furthermore, in some embodiments, the fastening screw has an oval head and square neck. It runs or extends through the first L-shape flat bar, the first latch segment, the second latch segment and the second L-shape flat bar, and then engages with threads on the knob handle. The neck of the screw is stuck, positioned and/or fixed in the first L-shape flat bar.

In some embodiments, the control mechanism comprises a housing, spring plate, and spanner. The lower part of the spring plate is fixed on the housing. The spanner can be moveably set inside the housing. The lower part of the spanner lies against the spring plate. The housing is fixed on the fixing plate and has a slideway. The supportblock runs or extends through the slideway and is held, supported, and/or secured by the spring plate.

In some embodiments, the control mechanism also includes elastic components. The elastic components are set or positioned between the spring plate and the housing, and connected or coupled to the spring plate and the housing respectively.

In some embodiments, the free arm umbrella also comprises a control handle, which is set or positioned on the second strut rod, near, adjacent, or in close proximity to the support block.

In some embodiments, the free arm umbrella includes three umbrella ribs and three support ribs.

The benefits of this these embodiments include but are not limited to: this free arm umbrella applies a scissor-type opening method, and is fixable on a wall or can be hung on a column with the fixing plate. In some embodiments, the rotating lockout mechanism enables the umbrella to swing or rotate, and the control mechanism facilitates the opening of the umbrella. With simple structure, easy operation, low cost and usability in a narrow space, this umbrella is suitable for large scale applications in some embodiments.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments.

DETAILED DESCRIPTION

Figure 1:
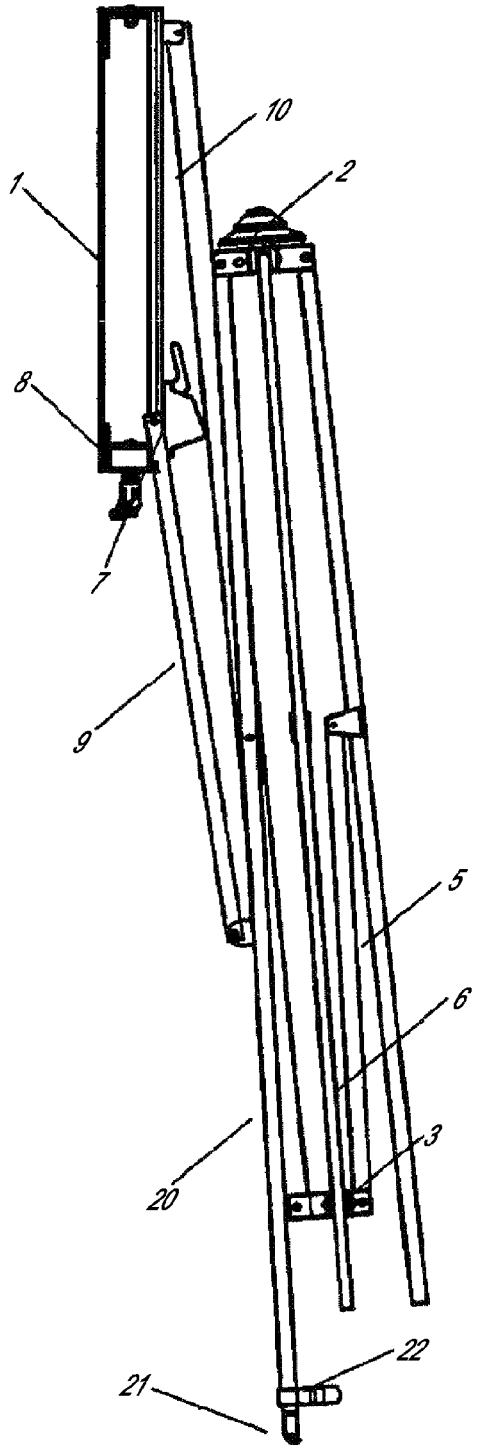
FIG. 1 is a front schematic view of an example of a free arm umbrella in a closed position.
Figure 2:
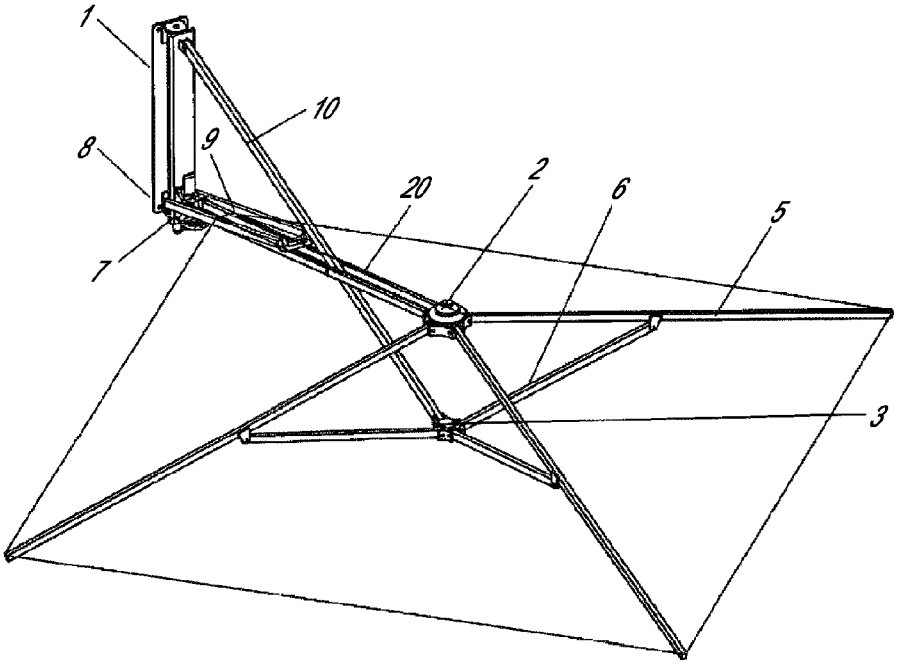
FIG. 2 is a perspective view of the example free arm umbrella as shown in FIG. 1 in an open position.

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein.

To articulate the technical characteristics of this application, examples of the free arm umbrella and various components herein are detailed below as an illustration of potential embodiments.

See FIGS. 1-6 for details of various embodiments. In some embodiments, the free arm umbrella includes a fixing plate 1, which is a type of wall mount structure that enables rotation of the free arm umbrella, upper hub (e.g., nest) 2, lower hub (e.g., nest) 3, umbrella ribs 5 and support ribs 6. The umbrella ribs 5 and support ribs 6 are a type of umbrella structural members. A shade providing structure can include the upper hub (e.g., nest) 2, lower hub (e.g., nest) 3, umbrella ribs 5 and support ribs 6. The umbrella ribs 5 are hingedly coupled with upper nest 2. The first and second ends of each of the support ribs 6 are hingedly coupled with lower nest 3 and umbrella ribs 5 respectively. The free arm umbrella includes a control mechanism 7, support rod 9, first strut rod 10 and second strut rod 20. The first and second ends of the first strut rod 10 are hingedly coupled with the lower nest 3 and fixing plate 1 respectively. One end of the second strut rod 20 is hingedly coupled with the upper nest 2, and the other end is provided with a support block 21. A middle part of the first strut rod 10 or middle portion disposed between the two ends of first strut rod 10 is hingedly coupled with a middle part of the second strut rod 20 or middle portion disposed between the two ends of the second strut rod 20. The first and second ends of the support rod 9 are hingedly coupled with the second strut rod 20 and the fixing plate 1 respectively. The control mechanism 7 is fixed on or coupled to the fixing plate 1. The support block 21 is moveably fixed on the control mechanism 7.

In some embodiments, the free arm umbrella also includes a rotating lockout mechanism 8, which is a type of umbrella positioning or rotation device. The fixing plate 1 includes a first fixing plate 11 and a second fixing plate 12. The rotating lockout mechanism 8 is set, positioned, supported and/or secured between the first fixing plate 11 and the second fixing plate 12, and respectively fixed onto or coupled to the two fixing plates. The support rod 9 is hingedly coupled with the second fixing plate 12, the control mechanism 7 is fixed on the second fixing plate 12, and first strut rod 10 is also hingedly coupled with the second fixing plate 12. In some embodiments, the upper part of the fixing plate 11 and the upper part of the fixing plate 12 are moveably or rotatably hinged together. See FIG. 6 for details. In some embodiments, the fixing plate 1 includes a first L-shape flat bar 13 and a second L-shape flat bar 14. The first L-shape flat bar 13 and the second L-shape flat bar 14 are respectively fixed to the first fixing plate 11 and the second fixing plate 12. The first L-shape flat bar 13 and the second L-shape flat bar 14 partially overlap each other and are connected by a screw 15, thus allowing for rotation between the first fixing plate 11 and the second fixing plate 12 in some embodiments if needed.

In some embodiments, the rotating lockout mechanism 8 includes a knob handle 81, fastening or carriage screw 82, first latch segment 83, and second latch segment 84. The first latch segment 83 engages with the second latch segment 84. The fastening screw 82 runs or extends through the first and second latch segments 83 and 84, and engages with the threads on the knob handle 81. The first latch segment 83 is fixed on or coupled to the second fixing plate 12, while the second latch segment 84 is fixed on or coupled to the first fixing plate 11. The support rod 9 is hingedly coupled with the second fixing plate 12 and the control mechanism 7 is fixed on or coupled to the second fixing plate 12. Preferably, the free arm umbrella is also equipped with a first L-shape flat bar 85 and a second L-shape flat bar 86. The first L-shape flat bar 85 and second L-shape flat bar 86 are fixed or coupled respectively with the second fixing plate 12 and the first fixing plate 11, and at the same time are held, secured, or supported respectively by the first latch segment 83 and second latch segment 84. See FIG. 6 for reference. In some embodiments, the fastening screw 82 has an oval head and square neck. It runs or extends through the first L-shape flat bar 85, the first latch segment 83, the second latch segment 84 and the second L-shape flat bar 86, and engages with the threads of the knob handle 81. The neck of the screw is received by or inserted in an opening of the first L-shape flat bar 85. The two L-shape flat bars 85 and 86 are fixed or positioned between the second fixing plate 12 and first fixing plate 11 respectively, thus enabling the first latch segment 83 and second latch segment 84 to loosen and engage through the round headed square necked screw 82, and allowing for the rotation between the second fixing plate 12 and first fixing plate 11 through the two L-shape flat bars 85 and 86.

In some embodiments, the control mechanism 7 comprises a housing 71, spring plate 72, and a spanner 73. The lower part of the spring plate 72 is fixed on the housing 71. The spanner 73 can be moveably set inside the housing 71. The lower part of the spanner 73 is positioned or lies against the spring plate 72. The housing 71 is fixed on the fixing plate 1 with a slideway 74. The support block 21 runs through the slideway 74 and is received by or secured by the spring plate 72. In some embodiments, the control mechanism 7 also includes one or more elastic components or biasing mechanisms 75. The elastic components 75 are set or positioned between the spring plate 72 and the housing 71, and respectively connected to the spring plate 72 and housing 71. See FIGS. 4 and 5 for reference. In some embodiments, the elastic components 75 refer to springs. The housing 71 is fixed on or secured to the second fixing plate 12.

Figure 3:
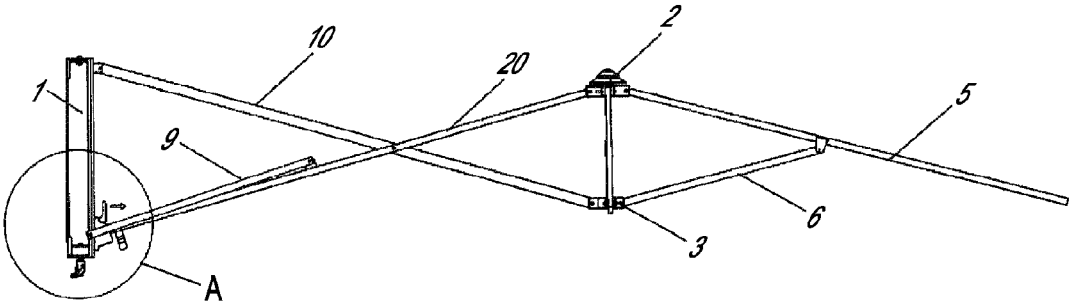
FIG. 3 is a side view of the example free arm umbrella as shown in FIG. 1 in an open position.
Figure 4:
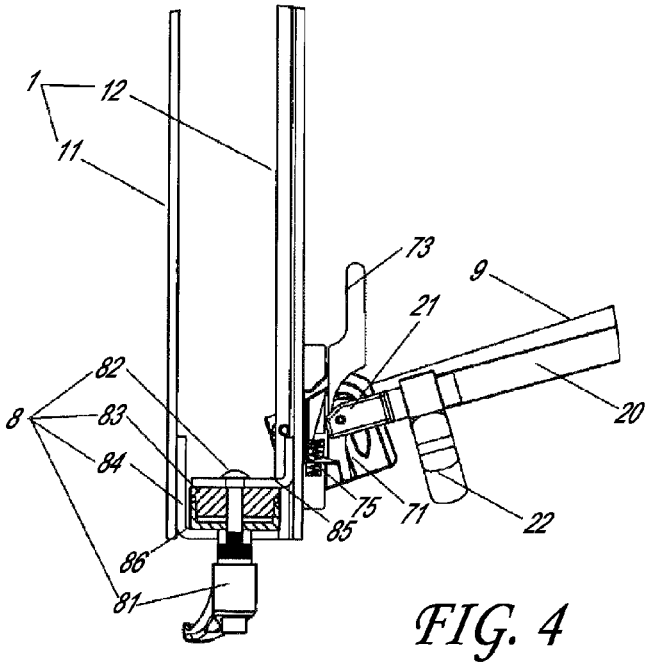
FIG. 4 is an enlarged view of the details of Area A of the example free arm umbrella as shown in FIG. 3.
Figure 5:
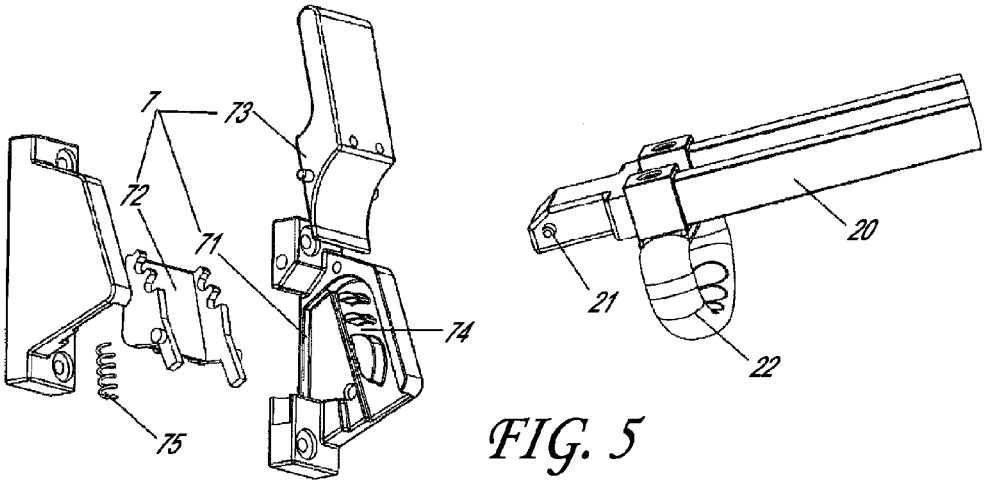
FIG. 5 is an exploded view of certain components of the example free arm umbrella as shown in FIG. 4.
Figure 6:
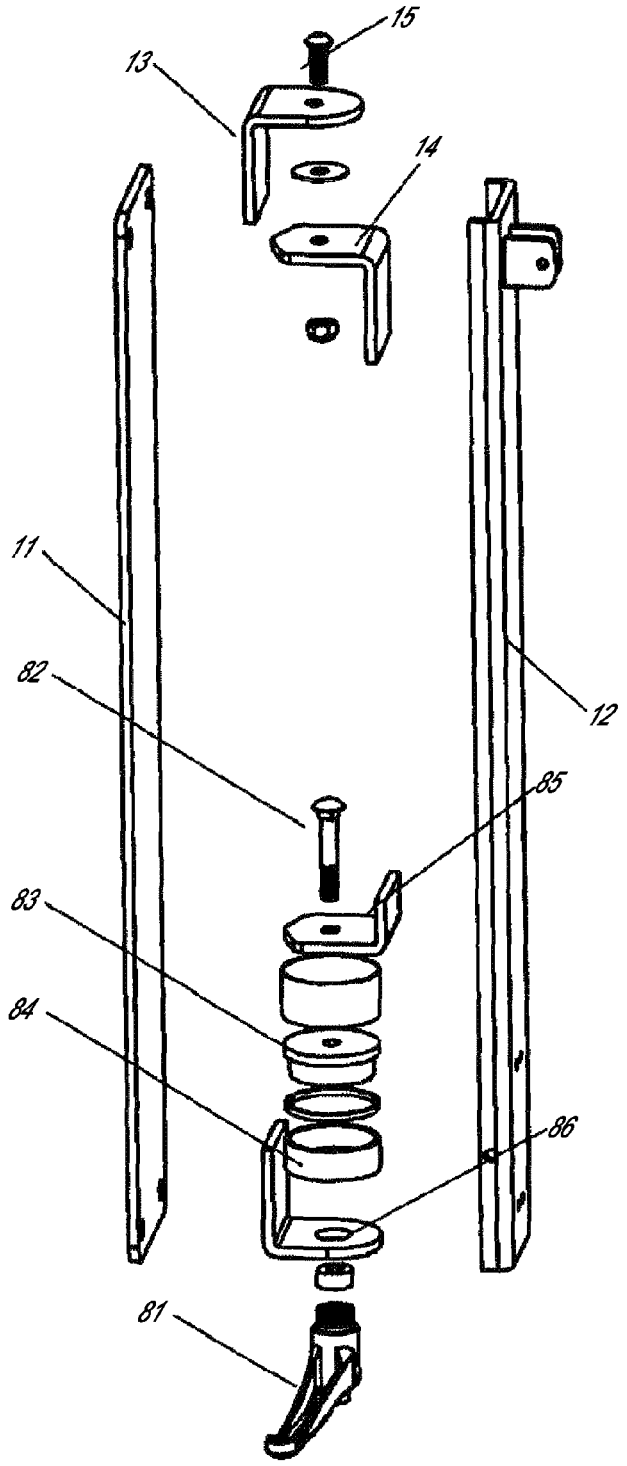
FIG. 6 is an exploded view diagram of an example fixing plate and rotating lockout mechanism of the free arm umbrella as shown in FIG. 2.

See FIG. 3-5 for details to facilitate operation by a user according to some embodiments. In some embodiments, the free arm umbrella also comprises a control handle 22, which is set, coupled to or positioned on the second strut rod 20, near, adjacent, or in close proximity to the support block 21.

Theoretically, there can be any number of umbrella ribs 5 and support ribs 6. See FIG. 2 for reference. In some embodiments, the free arm umbrella includes three umbrella ribs 5 and three support ribs 6.

To achieve specific or better sun-shading effect, the rotating lockout mechanism 8 is added to some embodiments. The fixing plate 1 is fixed on a wall in some embodiments. In certain embodiments, the free arm umbrella is hung on a column with the fixing plate 1. The rotating lockout mechanism 8 enables the umbrella to swing or rotate to provide shade or protection from the elements in a user desired area. In some embodiments, rotating or swinging the umbrella includes the steps of: turning the knob handle 81 left, loosening the carriage screw 82, loosening the first latch segment 83 and second latch segment 84, pushing the control handle 22, and swinging the umbrella surface from side to side. In some embodiments, fixing, locking or securing the umbrella into position includes turning the knob handle 81 right, tightening the carriage screw 82, and engaging the first latch segment 83 and second latch segment 84 to fix the umbrella position.

In some embodiments, to facilitate user operation, in opening the umbrella with the control mechanism 7, a user holds the control handle 22 to push the support block 21 on the second strut rod 20 into the slideway 74 of the housing 17 on the control mechanism 7. If the spring plate 72 holds or secures the support block 21, the umbrella can remain open. Referring to the arrow direction in FIG. 3, pulling the spanner 73 activates spring plate 72, thus loosening the support block 21. Holding the control handle 22 to withdraw support block 21 from the spring plate 72, allows a user to close the umbrella conveniently.

Figure 7:
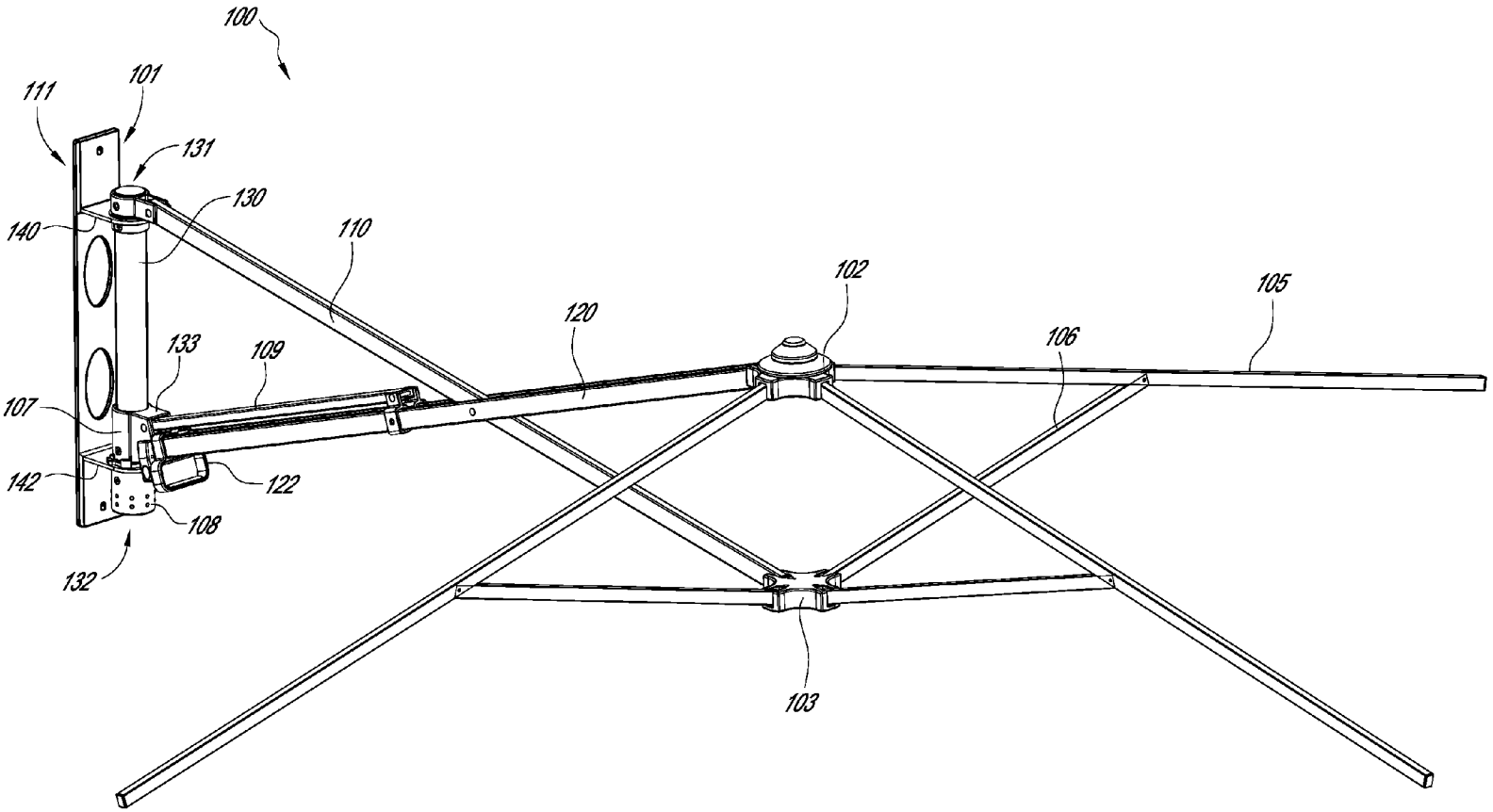
FIG. 7 is perspective view of another example free arm umbrella.
Figure 8:
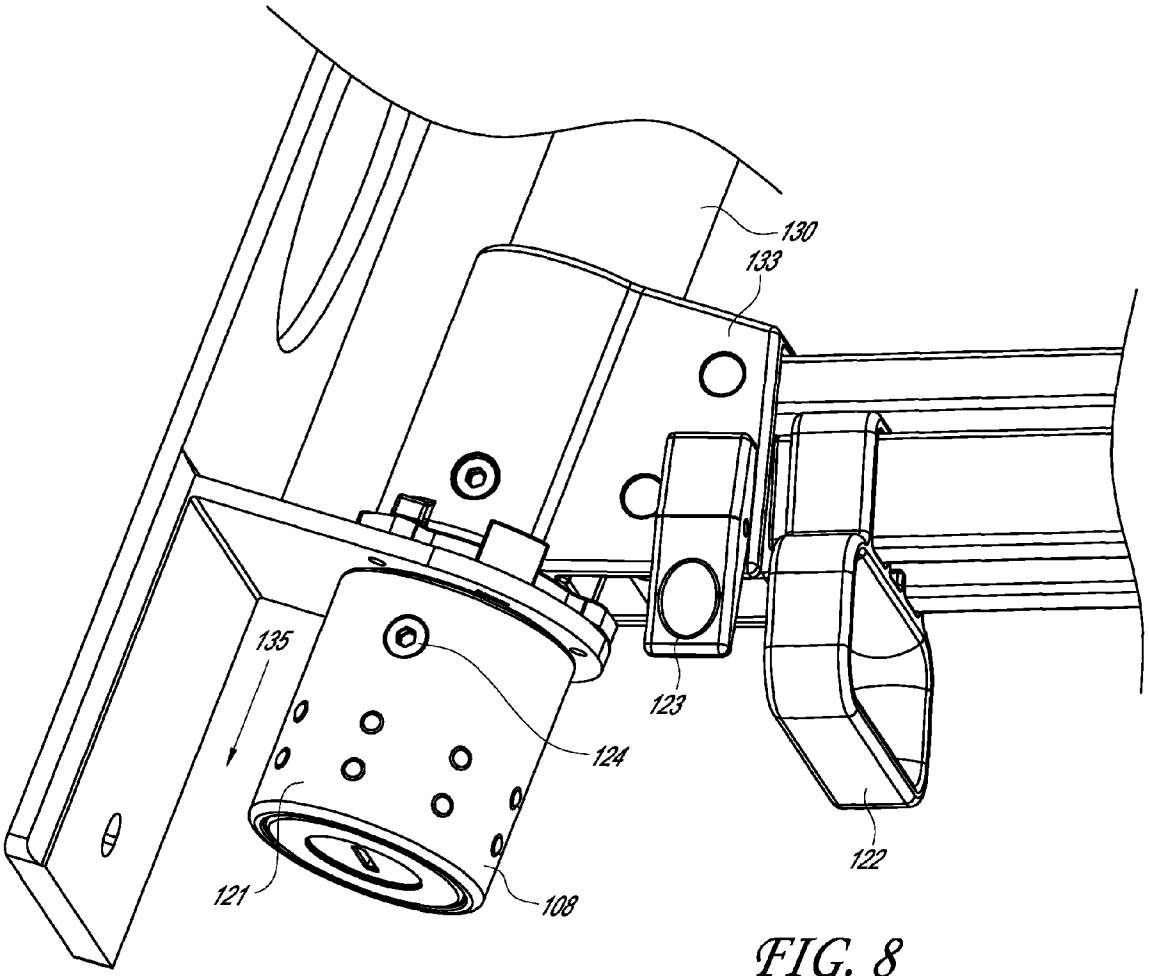
FIG. 8 is a detail view of the example free arm umbrella as shown in FIG. 7.
Figure 9:
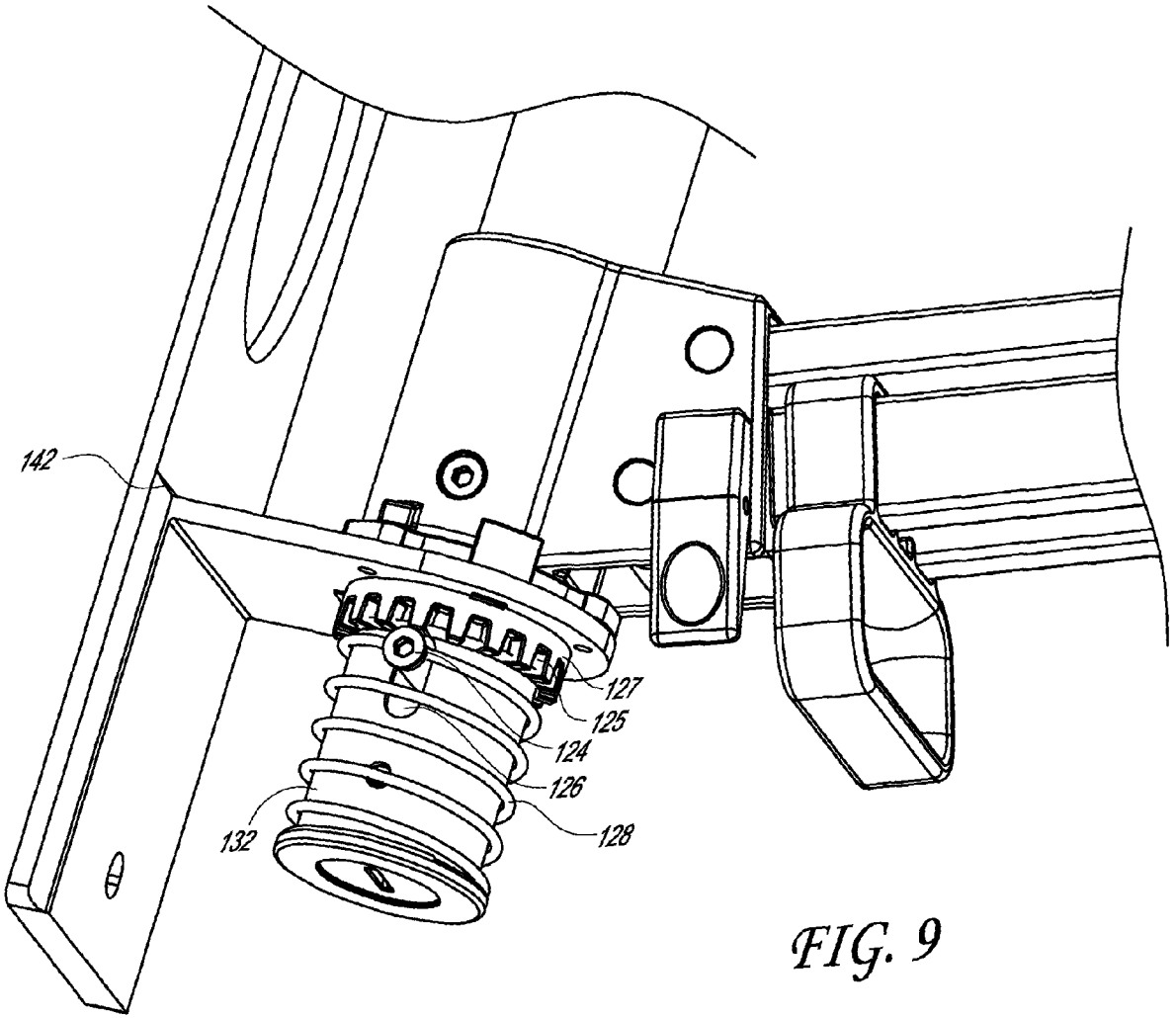
FIG. 9 is a partial view of the example free arm umbrella as shown in FIG. 8 with a handle removed.
Figure 10:
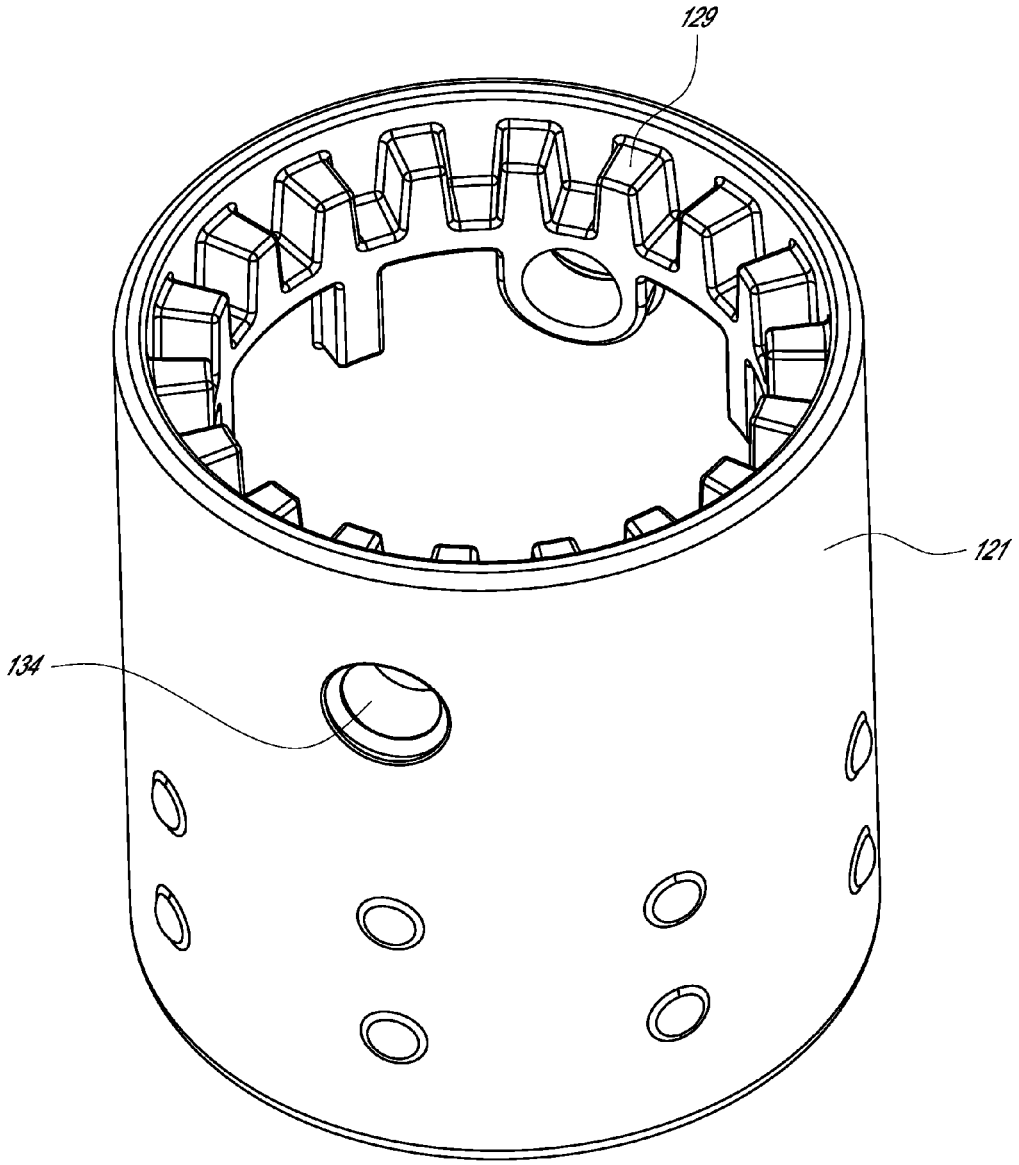
FIG. 10 is a top perspective view of the handle shown in FIG. 8 and removed in FIG. 9.

In another embodiment, as illustrated in FIGS. 7-13, a type of rotation device 108 is provided that is configured to allow a free arm umbrella, as described in any of the embodiments discussed above, to swing or rotate to a user selected position and be maintained in that position. The embodiment, as illustrated in FIGS. 7-8, can comprise one or more features of any of the free arm umbrella embodiments described above. For example, the free arm umbrella 100 can include a wall mount structure 101, a shade providing structure including an upper hub 102 (e.g., nest), lower hub 103 (e.g., nest), and a plurality of umbrella structural members (e.g., umbrella ribs 105, support ribs 106, etc.), a support rod 109, a first strut rod 110, a second strut rod 120, a control mechanism 107, and a support block 121. Any of the features of the embodiments illustrated in FIGS. 7-13 can be combined with any of the embodiments described above. The embodiments illustrated in FIGS. 7-13 can also comprise one or more different features. For example, the free arm umbrella can comprise a rotation device 108 as discussed in more detail below.

In some embodiments, the wall mount structure 101 is configured to mount the free arm umbrella 100 to a fixed structure (e.g., wall, upright surface, etc). The wall mount structure 101 can include a first portion 111 (e.g., plate, mount) for securing the free arm umbrella 100 to the fixed structure (not shown). The wall mount structure 101 can include a shaft 130 rotatably coupled to the wall mount structure 101 to enable the shade providing structure to be moved about an upright or vertical axis. In some embodiments, rotation of the shaft 130 rotates the shade providing structure.

In some embodiments, the free arm umbrella, as illustrated in FIGS. 7-13, can include the rotation device 108 configured to allow a user to move, swing or rotate the free arm umbrella 100 about the upright or vertical axis. The vertical axis can extend in a direction parallel to an axis extending between lower and upper ends 132, 131 of the shaft 130 which are pivotally mounted to the wall mount structure 101. In some embodiments, the shaft 130 (e.g., cylindrical pole) is rotatably fixed to the wall mount structure 101 via one or more mounts (e.g., an upper L-shaped mount 140 and a lower L-shaped mount 142) that are secured to the wall mount structure 101. In other embodiments, different shaped mounts can be used. The shaft 130 can be moveable (e.g., rotatable) relative to the mounts 140, 142. In some embodiments, the shaft 130 can extend through both the upper and lower mounts 140, 142 such that the upper end of the pole 131 of the shaft 130 extends above an upper surface of mount 140 and is hingedly coupled to one end of the first strut rod 110 opposite the other end of the first strut rod 110 coupled to the lower nest 103.

In such embodiments, a shaft 130 rotatably fixed to a wall mount structure 101 via one or more mounts provides a rotatable support structure for the free arm umbrella 100 having increased strength and robustness over other types of configurations.

In some embodiments, one end of support rod 109 can be hingedly coupled to second strut rod 120 opposite the other end of support rod 109 coupled to a lower portion of the shaft 130 either directly or indirectly via a housing 133 of the control mechanism 107 that is attached or secured to the shaft 130. In some embodiments, one end of the support rod 109 is received within an opening of the housing 133. The opening is positioned between two opposing sides of the housing 133. One end of the support rod 109 is hingedly coupled to the housing 133 via a pin or rod 150 configured to extend through the two sides and opening of the housing 133 and the end of the support rod 109. In some embodiments, second strut rod 120 can be hingedly coupled to upper nest 102 at one end and removably fixable to a lower portion of shaft 130, either directly or indirectly via the housing 133, at an opposite end.

In certain such embodiments, coupling one end of the support rod 109 to the housing 133 via a pin 150 extending through the two sides and opening of the housing 133 and the end of the support rod 109, provides a more robust or durable hinged coupling. Forces can be distributed more evenly onto the pin 150 and the housing 133.

In some embodiments, the second strut rod 120 can include two parallel rods spaced apart, extending between the upper hub 102 and the housing 133 when the free arm umbrella is in the open position. The first strut rod 110 can extend between the upper end 131 of the shaft 130 and the lower hub 130 while passing between the two parallel rods of the second strut rod 120 at a middle portion of the second strut rod 120. The second strut rod 120 can pivotally coupled to the first strut rod 110 at the middle portion where the second strut rod 120 bisects the space between the parallel rods of the first strut rod 110. Such a configuration allows the free arm umbrella to maintain its structural integrity and be folded up in the closed position as tightly (e.g., as small and compressed footprint) as possible.

As discussed above in previous embodiments, the free arm umbrella 100 can be moved into an open or closed position. In some embodiments, a user can hold handle 122 and push one end of second strut rod 120, opposite the end hingedly coupled to the upper nest 102, into engagement with the lower portion of shaft 130 or housing 133 (e.g., fixed to shaft 130) such that the second strut rod 120 is removably fixable to the shaft 130 or housing 133. When the second strut rod 120 is in such an engaged position, the free arm umbrella 100 is maintained or fixed in the open position. To close the free arm umbrella 100, the user can pull the handle 122 to disengage or release the second strut rod 120 from the shaft 130 or housing 133 and move the free arm umbrella 100 into the closed position.

Figure 11:
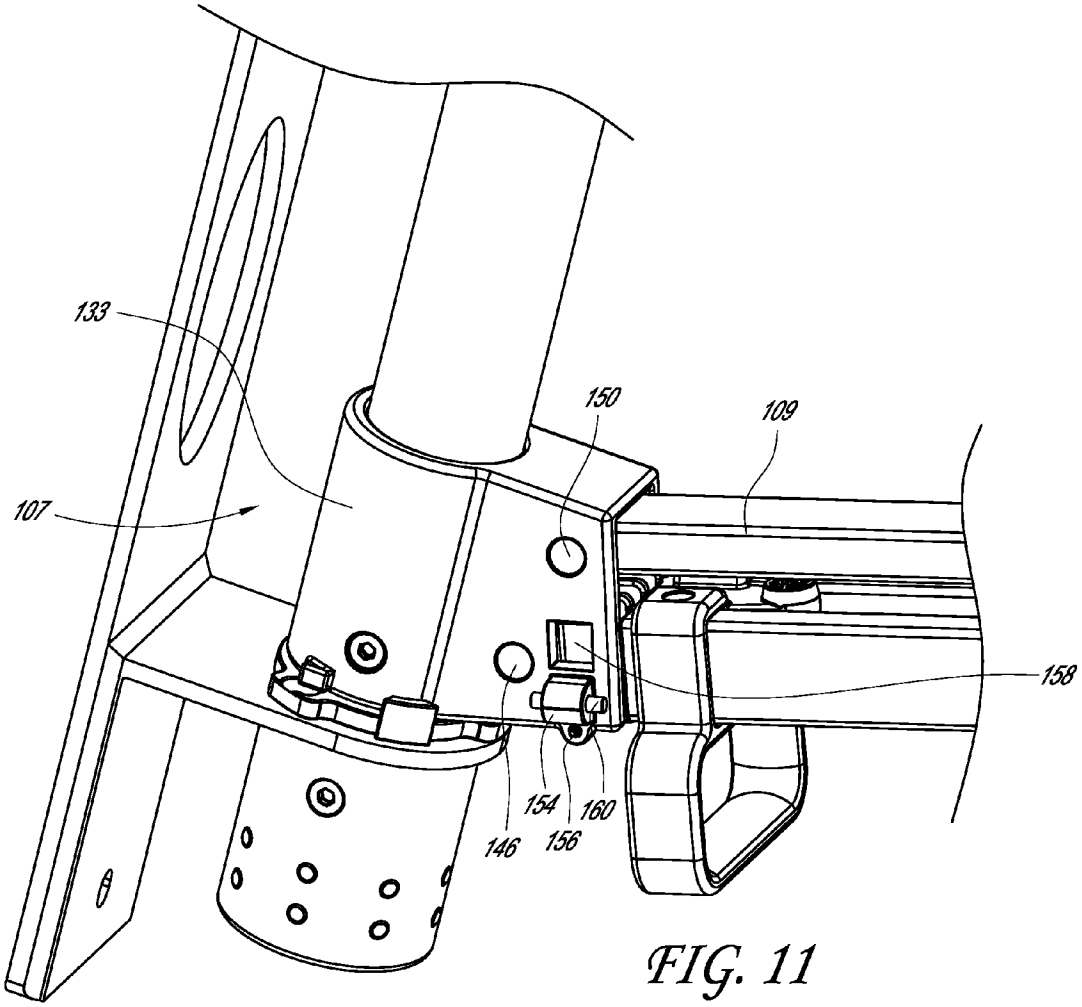
FIG. 11 is a partial view of the example free arm umbrella as shown in FIG. 8 with a pivotable member removed.
Figure 12:
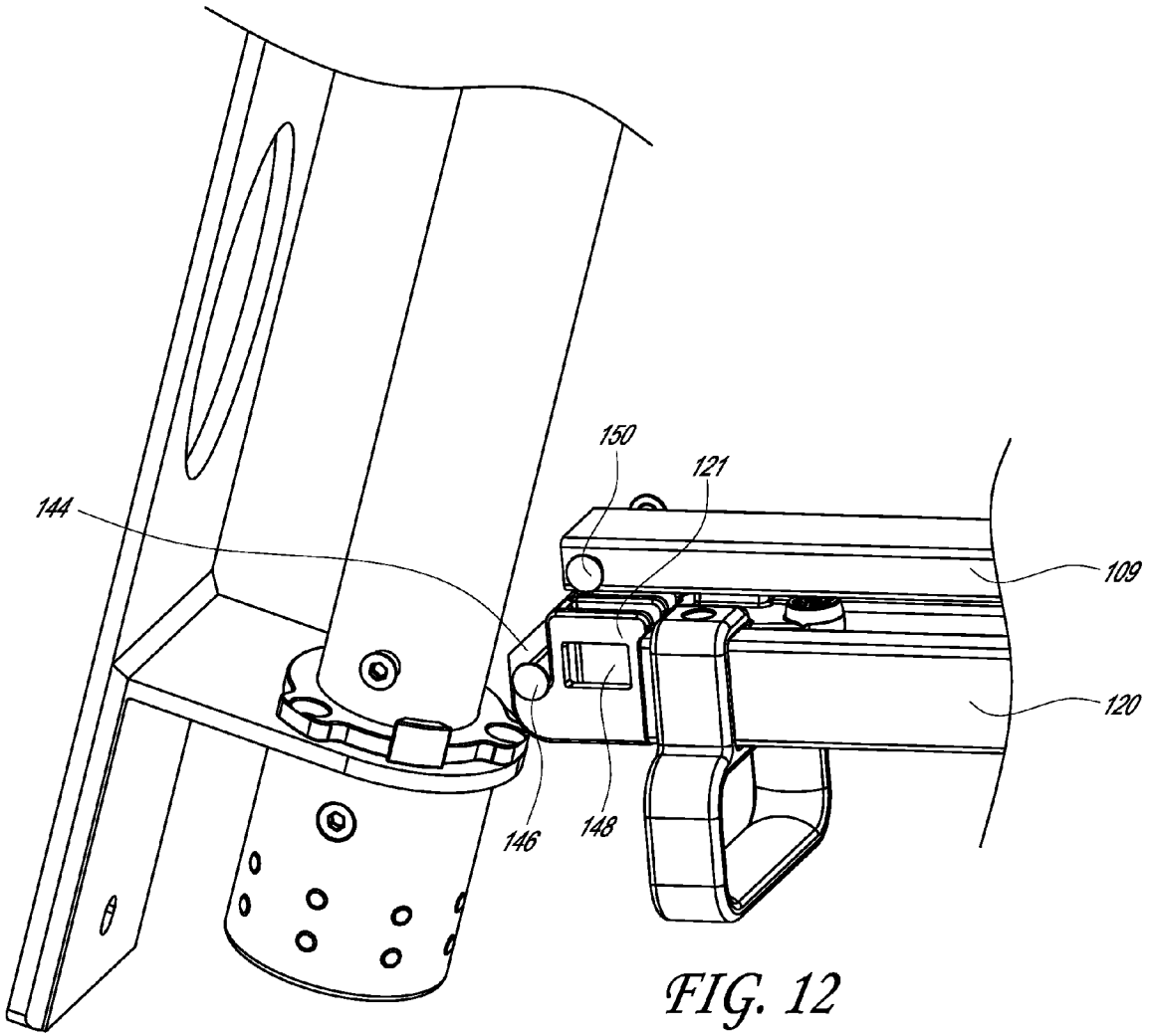
FIG. 12 is a partial view of the example free arm umbrella as shown in FIG. 8 with a housing removed.

As illustrated in FIGS. 11-12, in some embodiments, the second strut rod 120 can be provided with a support block 121 at one end. The support block 121 can include an engagement member 144 (e.g., u-shaped end, etc). The support block 121 is configured to be received within the opening in the housing 133 between two opposing sides of the housing 133. The engagement member 144 is configured to engage with and disengage from a shaft, pin or rod 146 coupled to and extending through the opening of the housing 133. When the engagement member 144 is engaged to the rod 146, the free arm umbrella 100 is maintained in the open position. When the engagement member 144 is disengaged from the rod 146, the free arm umbrella 100 is moveable to the closed position. In some embodiments, the engagement member 144 is configured to form a snap-fit engagement with the rod 146.

In certain such embodiments, such a snap-fit engagement between the engagement member 144 and rod 146 provides a less complex or more simple design. Such an engagement provides a design requiring less parts or components. The engagement member 144 can be engaged with the rod 146 in this simple, yet secure and effective manner.

In some embodiments, the control mechanism 7 includes a locking device 123 attached to the housing 133 and configured to secure or lock the second strut rod 120 in the engaged position (e.g., when the engagement member 144 is engaged to the rod 146). To release or disengage the second strut rod 120 from the engaged position, a user can press a bottom portion of locking device 123 and then move or pull the handle 122 to disengage the second strut rod 120 from the housing 133.

In some embodiments, the locking device 123 includes a pivotable member 166 configured to pivot about a support structure 154 attached to the housing 133 between locked and unlocked positions. The pivotable member 166 can include a protrusion 152 located on an upper portion of the pivotable member 166 and configured to be inserted into or received within recesses 148 and 158 (e.g., apertures, windows, channels) of the support block and housing 133 in the locked position to prevent accidental disengagement of the second strut rod 120 from the housing 133.

Figure 13:
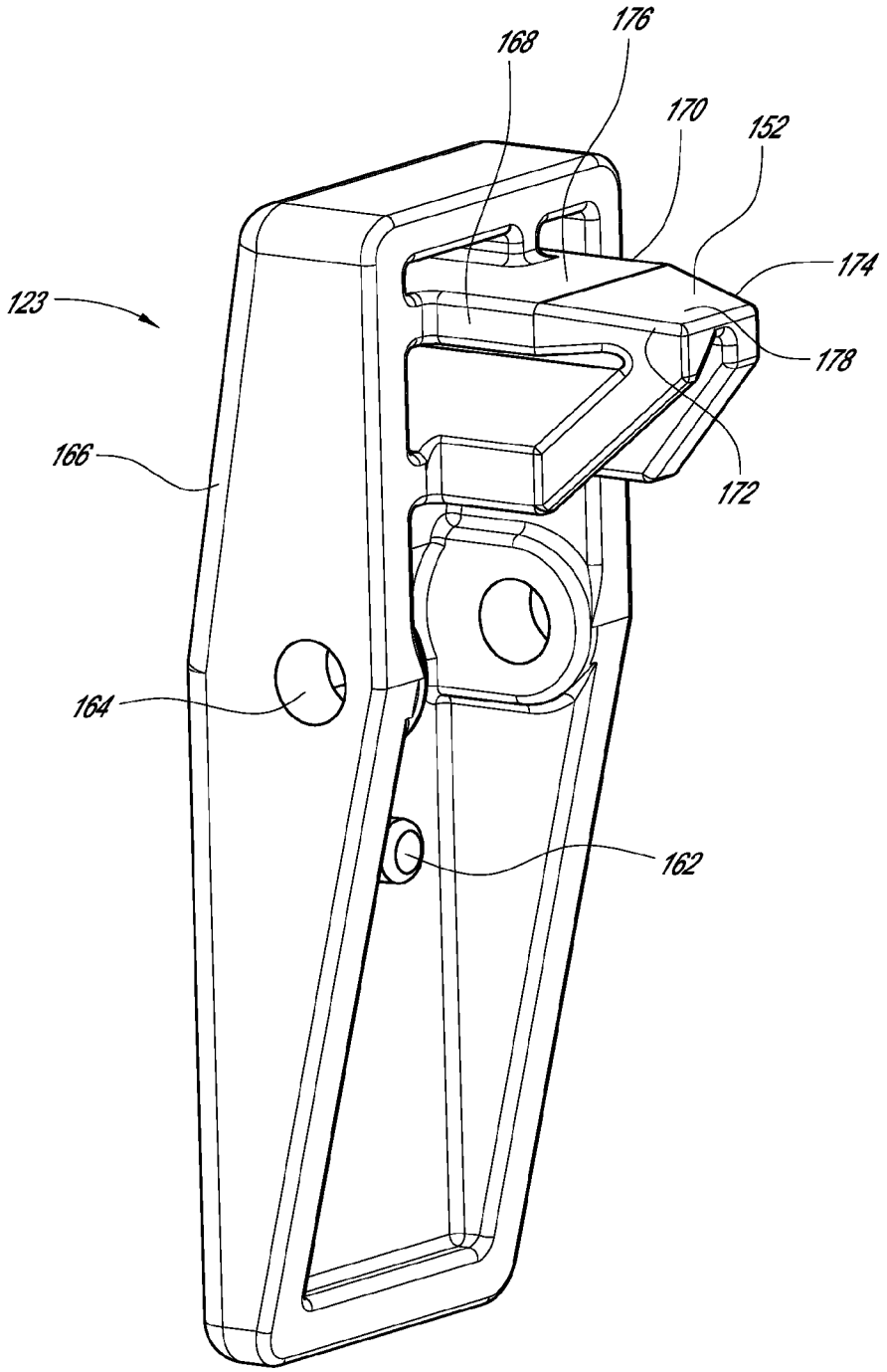
FIG. 13 is rear perspective view of the pivotable member as shown in FIG. 8 and removed in FIG. 11.

In some embodiments, the protrusion 152 can be configured to include a self-alignment feature. As illustrated in FIG. 13, one end 176 of the protrusion 152 can include two generally parallel surfaces 168 and 170 on opposing sides of the protrusion 152. At a second end 178, the protrusion 152 includes a downward sloping surface 172 extending from surface 168 towards the opposing side of the protrusion 152 and a downward sloping surface 174 extending from surface 170. The surfaces 168 and 170 can abut or generally follow the sides of the recess 158 such that the protrusion 152 can be self-aligned or guided into the recess 158 as the locking device 123 moves to the locked position. When the second strut rod 120 is in the engaged position, the recess 158 of the housing can be aligned with the recess 148 of the support block 121 such that a top surface of the recess 148 is positioned below a top surface of the recess 158. In such a configuration, as the locking device 123 is moved to the locked position, the surfaces 172 and 174 of the second end 178 are downward sloping such that they can be self-aligned or guided into the recess 148 along the top surface of the recess 148.

In some embodiments, the support structure 154 can include one or more pins 160 extending outwardly away from a central portion of the support structure 154. The one or more pins 160 are configured to extend through one or more corresponding apertures 164 positioned on the pivotable member 166 such that the pivotable member can pivot about an axis extending longitudinally through the one or more pins 160. The one or more pins 160 can be configured to act as a fulcrum about which the pivotable member 166 can pivot.

In some embodiments, the support structure 154 includes a biasing mechanism (not shown) (e.g., one or more springs or other elastic elements) configured to bias or maintain the pivotable member 164 in the locked position. In some embodiments, one end of the biasing mechanism abuts, contacts, or is centered on a protrusion 162 located on an interior surface of the pivotable member 164. An opposite end of the biasing mechanism abuts, contacts, or is centered on a protrusion 156 positioned on a surface of the support structure 154. The biasing mechanism is positioned between the surface of the support structure 154 and interior surface of the pivotable member 164 to maintain the pivotable member 164 in the locked position. The biasing mechanism and protrusions 156, 162 can be located below the one or more pins 160. In this type of configuration pressing or applying a force to a bottom portion of the pivotable member 166 compresses the biasing mechanism and moves a lower portion of the pivotable member 166 towards the housing 133. As the lower portion moves toward the housing 133, the upper portion of the pivotable member 164 moves laterally away from the housing 133. Thus, moving the protrusion 152 out of the recesses 148 and 158 and the locking device into the unlocked position. When a user releases the force applied to the pivotable member 166, the biasing mechanism biases the locking device 123 back to the locked position.

With reference to FIGS. 7-13, in some embodiments, the rotation device 108 can comprise, but is not limited to a handle 121 and a biasing mechanism 128 (e.g., spring, elastic element). The handle 121 is configured to be moveably secured to the lower end 132 of the shaft 130 via the biasing mechanism 128, a channel (e.g., recess, aperture, etc.) 126 in the lower end 132 of the shaft 130, a pin 124 (e.g., screw, nut and bolt, etc.), and corresponding first and second sets of engagement structures 129, 127. In some embodiments, the pin 124 is configured to extend through an aperture 134 of the handle 122 and channel 126. The pin 124 is coupled to a portion of the biasing mechanism 128 to secure the handle 121 to the lower end of the shaft 130 and biasing mechanism 128. Such a configuration permits the handle 122 to be moveably secured to the lower end of the shaft 132. The pin 124 is vertically translatable up and down within the channel 126 which permits the handle 121 to be vertically translatable.

In some embodiments, the rotation device 108 is vertically translatable between a first position (e.g., an engaged or locked position) and a second position (e.g., a disengaged or unlocked position). In the first position, the free arm umbrella 100 is fixed or locked in a position selected by a user wherein the first set of engagement structures 129 (e.g., protrusions, teeth, etc.) of the handle 122 mechanically engages to or mate with the corresponding second set of engagement structures 127 (e.g., protrusions, teeth, etc.) attached to a bottom surface of mount 142. This engagement prevents the free arm umbrella 100 from swinging or rotating about the vertical axis through the shaft 130 to different positions. A user can vertically translate the rotating mechanism 108 to the second position by holding the handle 122 and applying a downward force to the handle 122 indicated by arrow 135. By applying a downward force, the biasing mechanism 128 is biased or compressed, as the handle 121 translates downwardly. The corresponding engagement structures 129, 127 are disengaged as the handle 121 is translated downwardly. Upon disengagement of the corresponding engagement structures 129, 127, the free arm umbrella 100 is configured to be rotatable to a position selected by the user.

In some embodiments, the free arm umbrella 100 is configured to be rotatable less than or equal to about ±90, ±135, ±175 degrees from a vertical plane bisecting mid-points of the wall mount structure 101 and shaft 130. Releasing the handle 121 of the rotation device 108 in the second position, permits the rotation device 108 to return to the first position in which the corresponding engagement structures 129, 127 are configured to engage or mate to prevent further rotation of the free arm umbrella 100. For example, when the handle 121 is released when the rotation device 108 is in the second position, the biasing mechanism 128 biases the rotation device 108 back to the first position in which the engagement structures 129, 127 can engage or mate with each other.

In some embodiments, the first set of engagement structures 127 can comprise, but is not limited to, a cylindrical or circular pattern of downwardly extending teeth or protrusions, coupled to a bottom surface of mount 142, spaced apart around the perimeter of the shaft 130 with gaps or spaces 125 positioned between each tooth or protrusion. The corresponding second set of engagement structures 129 of the rotation device 108 can comprise, but is not limited to, a corresponding pattern of teeth or protrusions and gaps extending radially inwardly from an inner surface of handle 122 configured to mate or engage with the gaps and protrusions of the first set of engagement structures 127 to prevent rotation of the free arm umbrella 100.

In certain such embodiments, the rotation device 108 with engagement structures 129, 127 provides a robust and easy to use design for allowing a user to rotate and selectively maintain the free arm umbrella 100 in a desired position. The protrusions or teeth of the corresponding engagement structures 129, 127 provide a secure and strong mechanical engagement for preventing further rotation of the free arm umbrella 100. The steps for engaging and disengaging the rotation device 108 and rotating the free arm umbrella 100 are simplified. The rotation device 108 can allow a user to simply pull the handle 121 downwardly in one motion to move the rotation device into the disengaged position and then rotate the handle to move the free arm umbrella 100. The user can then simply release the handle 121 to return the rotation device 108 back into the engaged position. With such a rotation device 108, the user does not have to screw or unscrew a bolt several time to move the rotation device 108 between engaged and disengaged positions. Additionally. the user can use one hand to operate the rotation device 108 and rotate the free arm umbrella.

In some embodiments, the free arm umbrella of this application features simple structure, easy operation, low cost and usability in narrow places or areas, and is suitable for large scale application.

Although specific application of this umbrella has been articulated, more uses are available. Therefore, the explanation, description and appended figures are instructive, instead of restrictive or limiting. Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A free arm umbrella comprising:

a mount structure having an upper portion and a lower portion;

a shade providing structure comprising an upper hub and a lower hub coupled with the upper hub by a plurality of umbrella structural members;

a first strut rod and a second strut rod, wherein a first end of the first strut rod is pivotally coupled with the lower hub and a second end of the first strut rod is coupled with an upper portion of the mount structure, a first end of the second strut rod is pivotally coupled with the upper hub and a second end of the second strut rod is coupled with the mount structure; and a rotation device comprising a brake structure and a handle assembly, the rotation device configured to be moveable between first and second positions, wherein when the rotation device is in the first position the brake structure is engaged and the shade providing structure is prevented from rotating about an upright axis and wherein the rotation device enables the shade providing structure to rotate about an upright axis when in the second position wherein the mount structure comprises a first portion for securing the free arm umbrella to a fixed structure and a second portion rotatably coupled to the first portion to enable the shade providing structure to be moved about the upright axis, the brake structure comprising a first hinge coupler configured to rotatably couple a lower portion of each of the first and second portions, the mount structure further comprising a second hinge coupler configured to rotatably couple an upper portion of the each of the first and second portions;

wherein the second strut rod comprises a support block configured to be received by a control mechanism mounted to the second plate, and the control mechanism comprises a housing and a spring plate for securing the support block within the control mechanism to maintain the free arm umbrella in an open position;

wherein the control mechanism enables a user to push the support block into a slideway of the housing to secure the support block against the spring plate; and wherein the control mechanism comprises a spanner having a first portion set inside the housing and actuating the spanner releases the support block from the spring plate and enables a user to withdraw the support block from the control mechanism such that the second strut rod is detached from the housing.

2. The free arm umbrella of claim 1, wherein the brake structure comprises a first latch segment and a second latch segment, wherein the first latch segment is configured to engage with the second latch segment when the rotation device is in the first position.

3. The free arm umbrella of claim 2, wherein the first and second portion each comprise plates.

4. The free arm umbrella of claim 3, wherein the first hinge coupler is a first screw configured to couple the first and second latch segments, wherein the handle is rotatable between the first and second positions about the first screw.

5. The free arm umbrella of claim 1, further comprising a locking device having a first configuration for securing the support block to the housing to maintain the free arm umbrella in the open position and a second configuration for enabling the free arm umbrella to move between open and closed positions.

6. A free arm mount umbrella comprising:

a mounting structure having an upper portion and a lower portion, the mounting structure comprising a first plate and a second plate;

a shade structure comprising an upper hub and a lower hub coupled with the upper hub by a plurality of umbrella structural members;

a first and second pivotally connected members, wherein first and second ends of the first member are coupled with the lower hub and the mounting structure respectively;

a rotation device comprising a hand grip portion, a first locking component, a second locking component, and a fastening member, at least a portion of the first locking component configured to fit within the second locking component, the first locking component coupled to the second plate and the second locking component coupled to the first plate, the fastening member passing through a first aperture in the first locking component and a second aperture in the second locking component and configured to engage with the hand grip portion, the hand grip portion disposed below the first and second pivotally connected members and configured to rotate around a longitudinal axis of the fastening member, the rotation device having a first configuration for preventing rotation of the second plate and a second configuration for permitting rotation of the second plate wherein the hand grip portion translates along the fastening member between the first configuration and the second configuration;

wherein the second pivotally connected member comprises a support block configured to be received by a control mechanism mounted to the second plate, wherein the control mechanism comprises a housing and a spring plate for securing the support block within the control mechanism to maintain the free arm mount umbrella in an open position;

wherein the control mechanism enables a user to push the support block into a slideway of the housing to secure the support block to the spring plate; and wherein the control mechanism comprises a spanner having a lower portion set inside the housing and positioned against the spring plate, wherein pulling the spanner releases the support block from the spring plate and enables a user to withdraw the support block from the control mechanism such that the second pivotally connected member is detached from the housing to move the free arm umbrella to a closed position.

7. The free arm umbrella of claim 6, further comprising a locking device having a first configuration for securing the support block to the housing to maintain the free arm umbrella in the open position and a second configuration for enabling the free arm umbrella to move between open and closed positions.

8. A free arm umbrella comprising:

a mount structure comprising a first plate and a second plate, an upper portion of the first plate rotatably connected to an upper portion of the second plate and a lower portion of the first plate rotatably connected to a lower portion of the second plate;

a shade structure comprising an upper hub and a lower hub coupled with the upper hub by a plurality of umbrella structural members;

a first strut rod and a second strut rod, wherein one end of the first strut rod is pivotally coupled with the lower hub and another end of the first strut rod is pivotally coupled with the upper portion of the first plate, one end of the second strut rod is pivotally coupled with the upper hub and another end is coupled with the lower portion of the first plate;

a rotation device coupled to the lower portions of the first and second plates, the rotation device comprising a hand grip portion, a first locking component, a second locking component, and a fastening member, at least a portion of the first locking component configured to engage with the second locking component, the first locking component coupled to the second plate and the second locking component coupled to the first plate, the fastening member passing through the first and second locking components and configured to engage with the hand grip portion, the hand grip portion disposed below the first and second strut rods and configured to rotate around a longitudinal axis of the fastening member, the rotation device having a first configuration for preventing rotation of the second plate and a second configuration for permitting rotation of the second plate wherein the hand grip portion translates along the fastening member parallel to the longitudinal axis between the first configuration and the second configuration;

wherein the second strut rod comprises a support block configured to be received by a control mechanism of the second plate, wherein the control mechanism comprises a housing and a spring plate;

wherein the control mechanism enables a user to push the support block into a slideway of the housing; and wherein the control mechanism comprises a spanner having a first portion configured to actuate the spring plate and a second portion outside of the housing, wherein pulling the second portion of the spanner enables a user to withdraw the support block from the control mechanism such that the second strut rod is detached from the housing.

9. The free arm umbrella of claim 8, wherein the control mechanism comprises a control handle to enable the user to push the support block into the slideway of the housing to secure the support block to the spring plate and enable the user to withdraw the support block from the spring plate when the spanner is pulled to release the support block from the spring plate.

10. The free arm umbrella of claim 8, further comprising a support rod having a first end hingedly coupled with the second strut rod and a second end hingedly coupled with the first plate.

11. A free arm umbrella structure comprising:

a shade structure comprising an upper hub and a lower hub coupled with the upper hub by a plurality of umbrella ribs;

a first strut rod having a first and a second end, the first strut rod pivotally coupled with the lower hub at the first end;

a second strut rod having a first and a second end, the second strut rod pivotally coupled with the upper hub at the first end;

a fixture comprising:

a base configured to be coupled with a fixed structure;

an elongate support having an upper end pivotably coupled with the second end of the first strut rod, the elongate support having a lower end pivotably coupled with the second end of the second strut rod, the elongate support having an upper end pivotably coupled to the base to allow the first and second strut rods and the shade structure coupled therewith to be positioned about an axis; and a brake assembly comprising a first latch segment rigidly coupled to the lower end of the fixture, a second latch segment rigidly coupled to the lower end of the fixture, the first latch comprising a concave space formed therein, the second latch segment comprising a projection extending therefrom, the projection configured to be received in the concave space;

wherein the brake assembly further comprises an actuating handle configured to engage the projection in the concave space to fix the position of the shade structure.

12. The free arm umbrella structure of claim 11, wherein the first latch segment is fixed with the elongate support and the second latch segment is fixed with the base.

13. The free arm umbrella structure of claim 11, wherein an outer surface of the projection engages an inner surface of the concave space to frictionally fix the position of the shade structure.

14. The free arm umbrella structure of claim 11, wherein the actuating handle comprises a rod extending through the second latch segment and the projection.

15. The free arm umbrella structure of claim 11, wherein the first latch segment comprises an L-shaped bracket.

16. The free arm umbrella structure of claim 11, wherein the base comprises a flat plate.

17. The free arm umbrella structure of claim 11, wherein the second strut rod comprises a support block configured to be received by a control mechanism mounted to the second portion, wherein the control mechanism comprises a housing for securing the support block within the control mechanism to maintain the free arm umbrella in an open position.

* * * * *